US006259410B1

(12) United States Patent
Chang

(10) Patent No.: US 6,259,410 B1
(45) Date of Patent: Jul. 10, 2001

(54) ANGLE ADJUSTING MECHANISM FOR ANTENNA

(75) Inventor: Mu Jung Chang, Hsinchu (TW)

(73) Assignee: Tranwo Technology Corp., Hsinchu (TW)

( * ) Notice: Subject to any disclaimer, the term of this patent is extended or adjusted under 35 U.S.C. 154(b) by 0 days.

(21) Appl. No.: 09/659,598

(22) Filed: Sep. 11, 2000

(51) Int. Cl.[7] ..... H01Q 1/24
(52) U.S. Cl. ..... 343/702; 343/757
(58) Field of Search ..... 343/702, 757, 343/882, 878; 455/90

(56) References Cited

U.S. PATENT DOCUMENTS 5,513,383 * 4/1996 Tsao ..... 455/90
5,949,379 * 9/1999 Yang ..... 343/702

* cited by examiner

*Primary Examiner*—Don Wong
*Assistant Examiner*—Hoang Nguyen
(74) *Attorney, Agent, or Firm*—Martine & Penilla, LLP

(57) ABSTRACT

This invention is to provide an angle adjusting mechanism for an antenna to be used to connect between an antenna and its casing. The angle adjusting mechanism includes a casing provided with a pivoting recess, an antenna provided with a connecting sleeve, and a linking member which has a hollow body and a first, second and third pivoting sleeves formed in T-shape. The first pivoting sleeve is pivotably connected to the connecting sleeve of the antenna; the second and third pivoting sleeves are pivotably connected to the pivoting portion of the casing. The characteristics of this is that each of the first, second, and third pivoting sleeves of the linking member is provided with a slotted or split free end and a resilient tab through which to achieve an resilient design. When connecting the linking member between the antenna and the casing, the resilience of the mechanism per se provides a damping effect capable of retaining the antenna at any desired angular position without the necessity of installing any extra parts such as O rings.

7 Claims, 5 Drawing Sheets

31A

31B

14

ANGLE ADJUSTING MECHANISM FOR ANTENNA

BACKGROUND OF THE INVENTION

1. Field of the Invention

This invention relates to an antenna angle adjusting mechanism for a wireless audio/video transmitter.

2. Description of the Prior Art

With regard to an antenna for transmitting and receiving high frequency signals, it is essential that the azimuth angle and the elevation angle of the antenna may be widely adjusted so as to reduce the blind comer for transmitting and receiving signals. FIG. 1 is an exploded perspective view showing the angle adjusting mechanism for an antenna 110 in a conventional wireless video and audio transmitter. In this case, the antenna 110, having a connecting sleeve 111, is connected to a casing 120 through a hollow tube 100 including three pivoting sleeves 101, 102 and 103 which form a generally T-shaped appearance. The pivoting sleeve 101 is connected to the antenna 110 through the connecting sleeve 111 which enables the antenna 110 to rotate around the axis of the pivoting sleeve 101 of the hollow tube 100 in order to adjust the azimuth angle of the antenna 110. The other two pivoting sleeves 102 and 103 are aligned to each other and are pivotably connected to the pivoting recess 121 of the casing 120, which enables the hollow tube 100 to pivot relative to the casing 120 around the axis of the two pivoting sleeves 102 and 103 so as to adjust the elevation angle of the antenna 110.

After the angle of the antenna 110 has been adjusted to a desired position, the antenna 110 must be retained at the same position so as to optimize its transmitting and receiving capability. To this end, when the above mentioned three pivoting sleeves 101, 102, and 103 of the hollow tube 100 are pivotably connected to the casing 120 and the antenna 110, an O ring 105 made of resilient material such as rubber must be interposed between the connected portions for generating a damping effect to maintain the antenna 110 at a desired position after angle adjustment.

One drawback of the above mentioned prior art is that each of the three pivoting sleeves of the hollow tube 100 requires to be assembled with an O ring 105, which causes an increased assembly costs due to increment in the time and material required for assembly.

SUMMARY OF THE INVENTION

One object of this invention is to provide an angle adjusting mechanism for an antenna, which, through its own resilience design without the necessity of installing any extra parts such as O rings, may generate a damping effect for retaining the antenna at a desired position when connecting the antenna and the casing in order to reduce the assembly cost.

Another object of this invention is to provide an angle adjusting mechanism for an antenna which includes a linking member with a bigger internal wiring space in order to ease the assembly.

Yet another object of this invention is to provide an angle adjusting mechanism for an antenna which have a linking member formed by a pair of half-housings combined together by use of tenon and mortise joint which can accurately fasten the two together when assembling.

In order to achieve the above-mentioned objects, this invention provides an angle adjusting mechanism for an antenna adapted to connect the antenna to its casing, including:

a pivoting portion provided in the casing;

a connecting sleeve provided in the antenna; and a linking member having a hollow body, a first pivoting sleeve, a second pivoting sleeve, and a third pivoting sleeve, with the first, second and third pivoting sleeves being integrally attached to the hollow body, and with the second and third pivoting sleeves being aligned with each other and substantially perpendicular to the first pivoting sleeve to form a generally T-shape; the first pivoting sleeve being connected, at the free end thereof, to the connecting sleeve of the antenna, and the second and third pivoting sleeves being pivotably connected, at respective free end thereof, to the pivoting portion of the casing so that the antenna may be pivotably connected to the casing through the linking member;

characterized in that each of the first, second, and third pivoting sleeves of the linking member is provided with a split or slotted free end and resilient tabs for pressing against the portions connected with the first, second, and third pivoting sleeves in an assembled state so that the first, second, and third pivoting sleeves may be connected to the connecting sleeve of the antenna and the pivoting portion of the casing in a resilient manner.

Through the above construction, when the linking member is used to connect the antenna to the casing, the resilience effect of its own can provide a damping effect without installing a member for increasing frictional resistance so as to simplify the production and reduce the cost.

Furthermore, the sphere shaped hollow body of the linking member provides a bigger internal wiring space which facilitates the assembly. Besides, the linking member is formed by a pair of half-housings combined together by use of tenon and mortise joint so that the pair of half-housings can be accurately fastened together.

Other objects, advantages and characteristics of this invention will become apparent from the detailed description to follow taken in conjunction with the drawings.

DETAILED DESCRIPTION OF THE PREFERRED EMBODIMENTS

Figure 1:
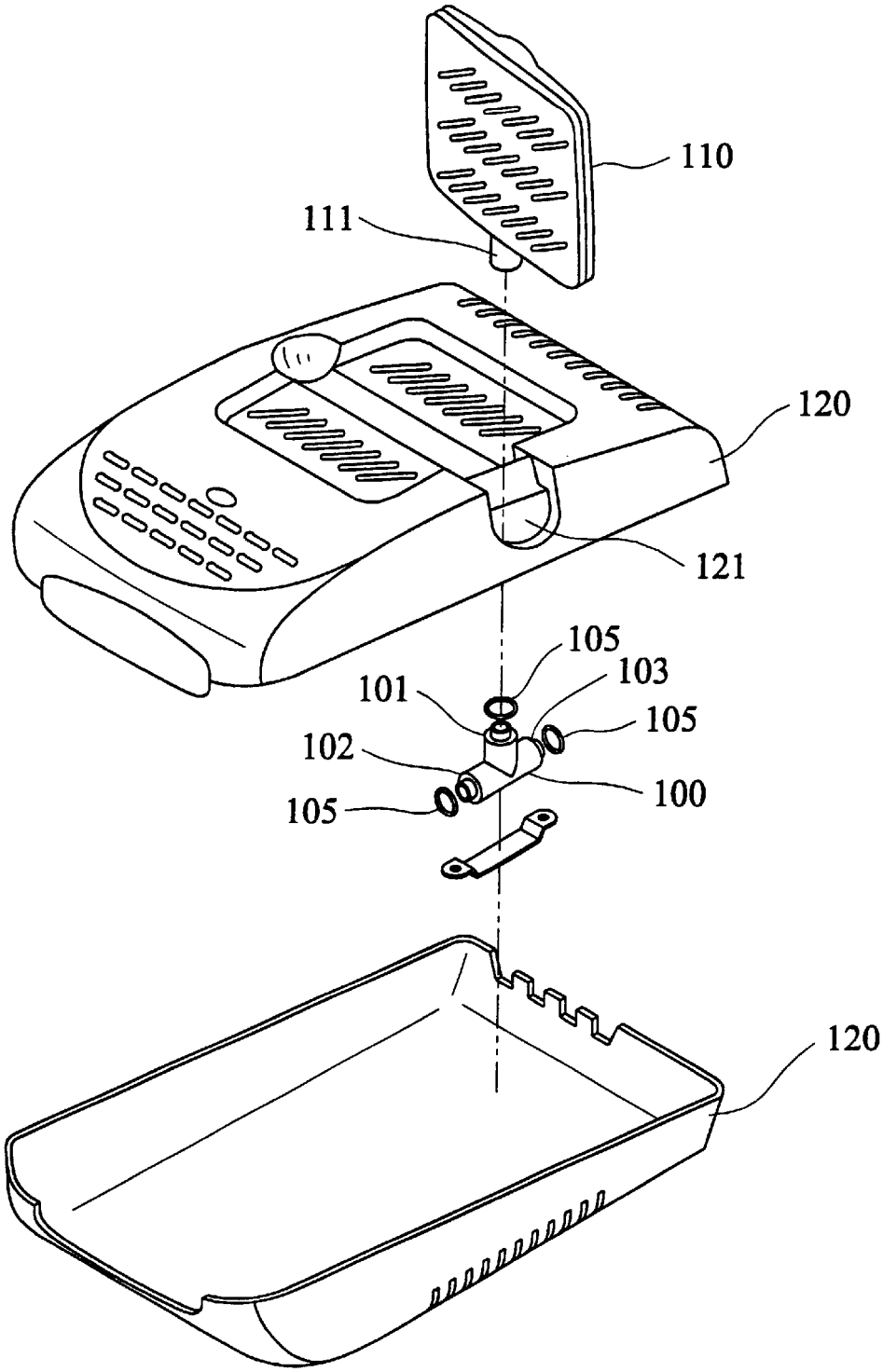
FIG. 1 (PRIOR ART)
FIG. 1 is an exploded perspective view showing the angle adjusting mechanism for an antenna in a conventional wireless video and audio transmitter.
Figure 2:
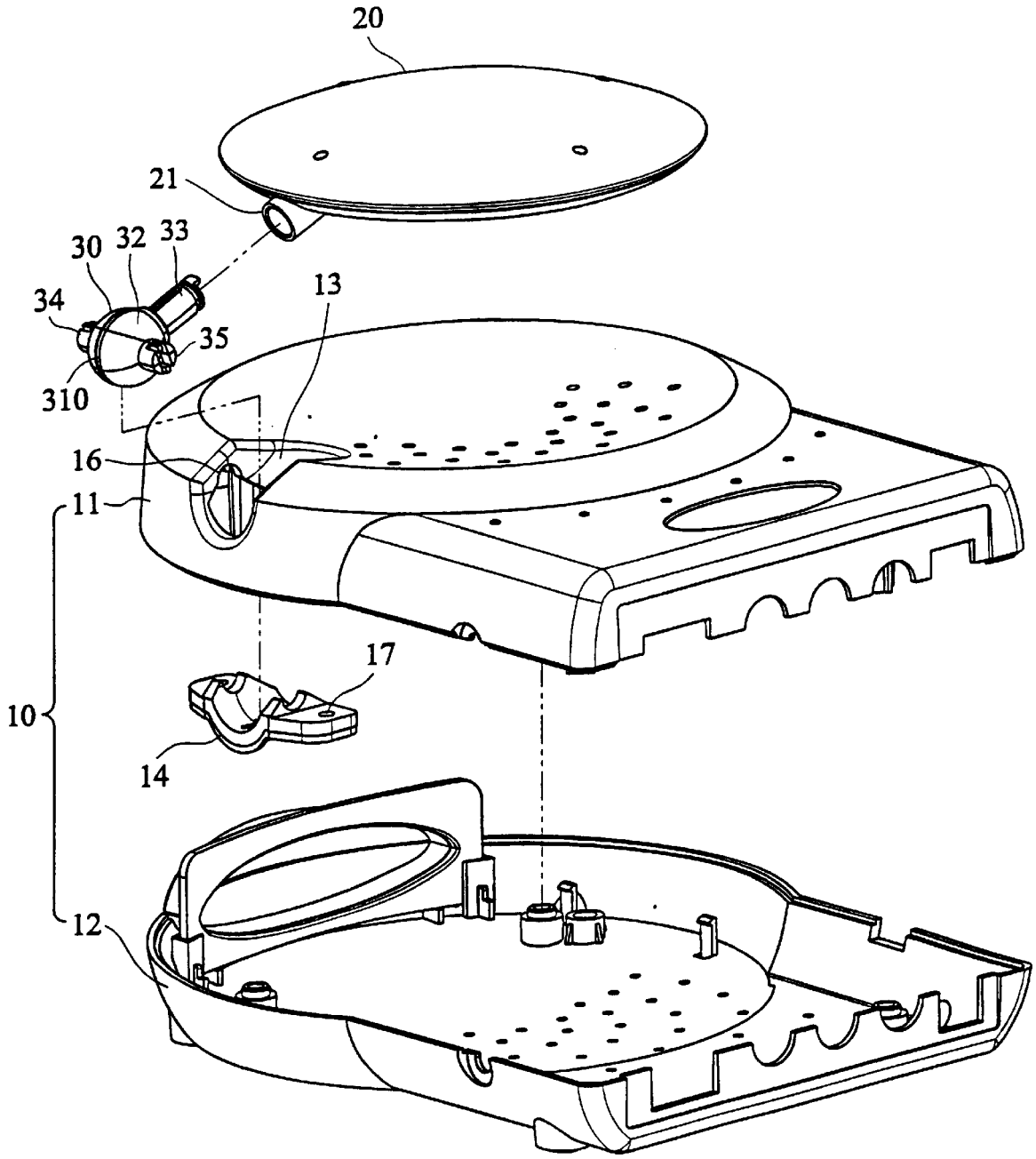
FIG. 2 is an exploded perspective view showing the angle adjusting mechanism for an antenna according to an embodiment of this invention.
Figure 3:
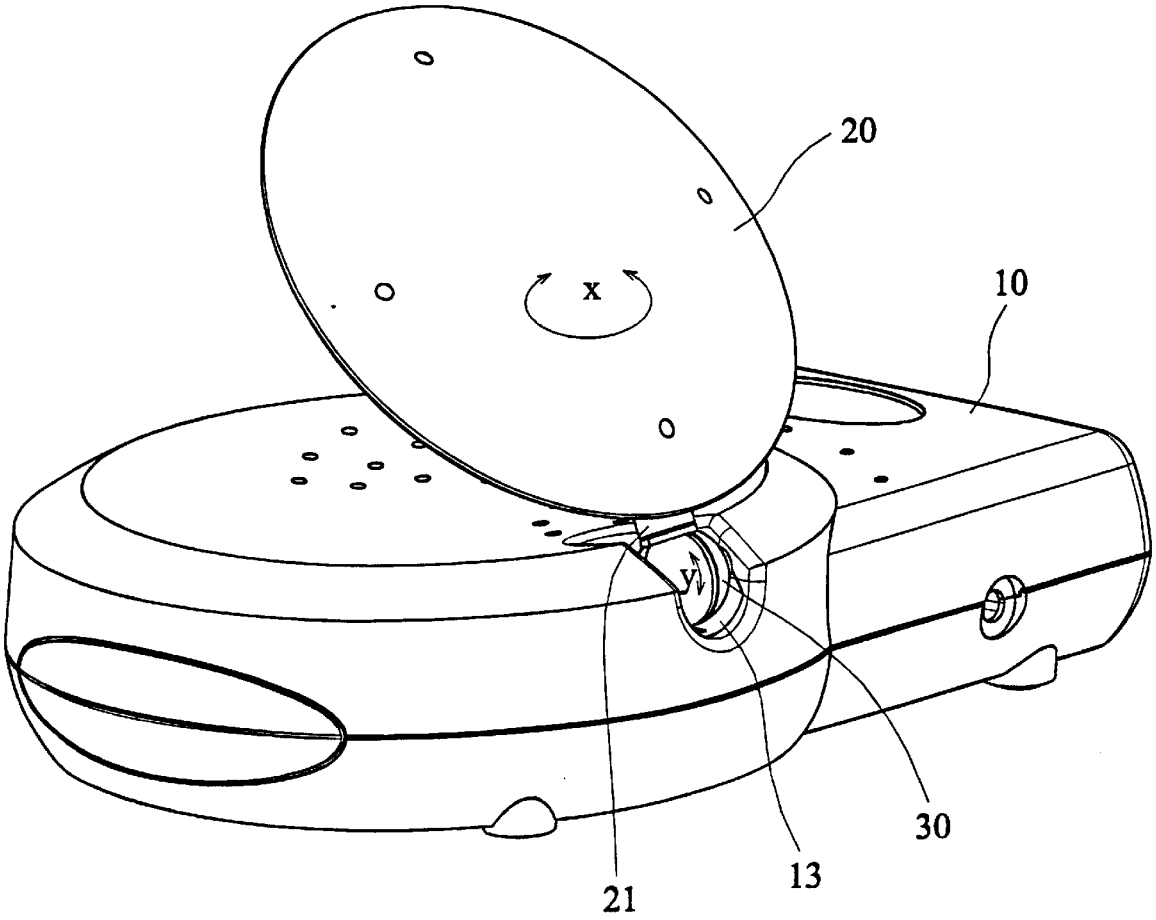
FIG. 3 is an assembled perspective view of the same angle adjusting mechanism for an antenna.
Figure 4:
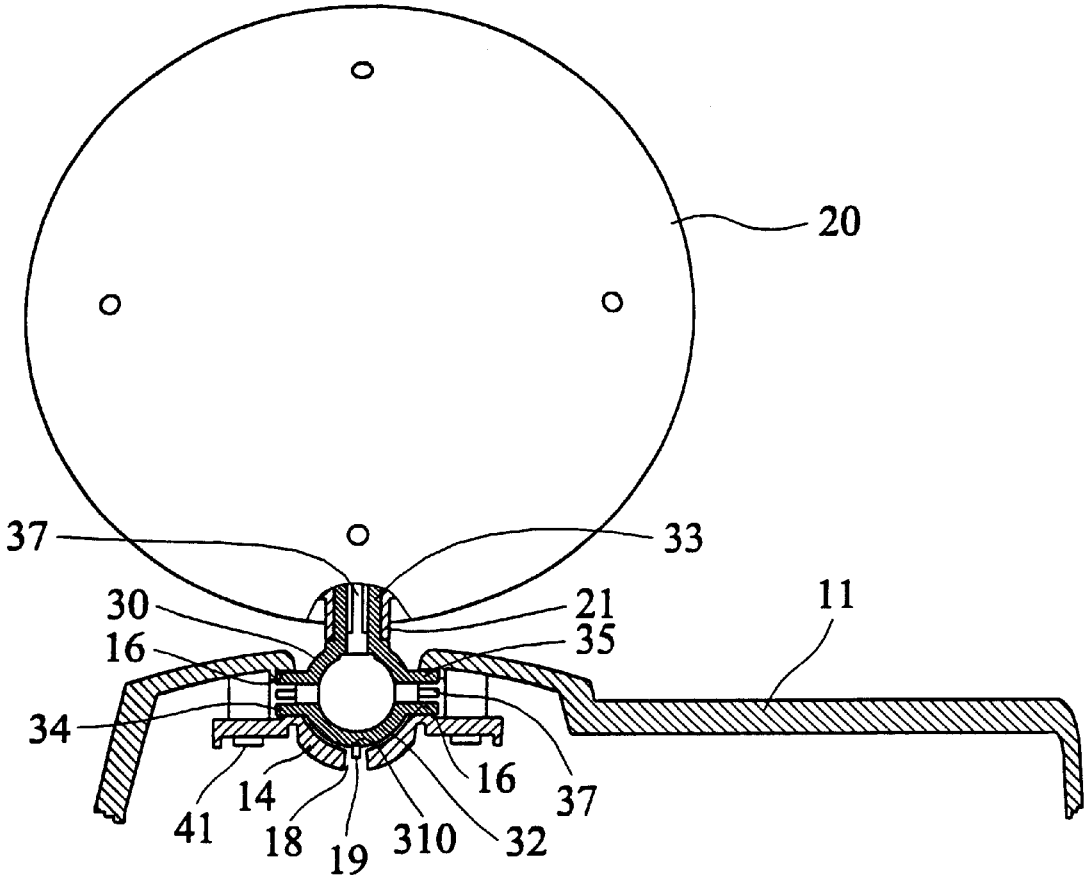
FIG. 4 is an assembled sectional view of the same angle adjusting mechanism for an antenna.

With reference to FIGS. 2, 3, and 4, the preferred embodiment of this invention includes a casing 10, an antenna 20 and a linking member 30 for pivotably connecting the antenna 20 to the casing 10.

The casing 10 is formed by combining the upper casing 11 and lower casing 12 together. The upper casing 11 is provided with a recessed pivoting portion 13 within which is mounted a bearing piece 14 for bearing beneath the linking member 30 in an assembled state (see FIG. 4) as to be explained in more detail later. The recessed pivoting portion 13 are provided with a pair of aligned pivoting holes 16.

The antenna 20 has a connecting sleeve 21 on its periphery.

Figure 5A:
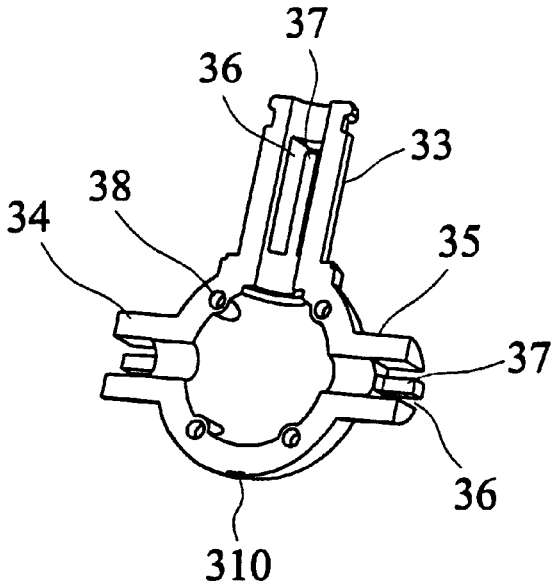
FIGS. 5(A), 5(B) are perspective views each showing half of a linking member included in the same angle adjusting mechanism for an antenna.
Figure 5B:
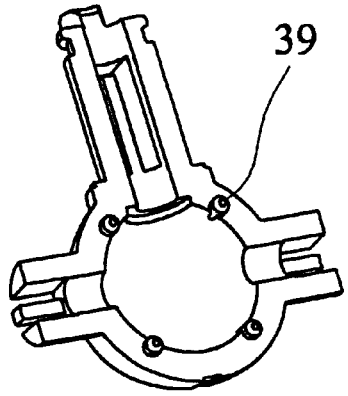

With reference to FIGS. 5(A) and 5(B), the linking member 30 is comprised of two half housings 31 A and 31 B which form a hollow housing when combined together. On the inner surface of one half housing 31 A, there are four mortise 38. On the inner surface of the other half housing 31B, there are four tenons 39 to lock the four mortise 38, respectively, for accurately positioning the two half housings 31A and 31B relative to each other, and combining them together to form the linking member 30. The thus formed linking member 30 has a spherical hollow body 32, a first pivoting sleeve 33, a second pivoting sleeve 34, and a third pivoting sleeve 35. The hollow body 32 is provided with a groove 310 (see also FIG. 2) on the outside surface thereof.

The first pivoting sleeve 33, the second pivoting sleeve 34, and the third pivoting sleeve 35 are integrally attached to the hollow body 32. The second and third pivoting sleeves 34, 35 are aligned with each other and substantially perpendicular to the first pivoting sleeve 33 to form a generally T-shape. The first pivoting sleeve 33 is connected, at its free end, to the connecting sleeve 21 of the antenna 20, and the second and third pivoting sleeves 34, 35 are pivotably connected, at respective free end thereof, to the pair of aligned pivoting holes 16 of the pivoting portion 13. Each of the first, second, and third pivoting sleeves 33, 34 and 35 is provided with a split or slotted free end 36 and resilient tabs 37 for pressing against the inner walls of the connecting sleeve 21 and the pivoting holes 16 connected with the pivoting sleeves 33, 34 and 35 in an assembled state, so that the linking member 30 may be connected to the antenna 20 and the casing 10 through the pivoting sleeves 33, 34 and 35 in a resilient manner.

Figure 6:
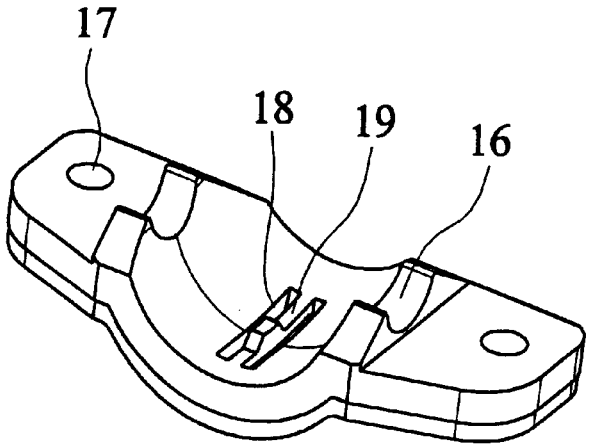
FIG. 6 is a perspective view showing a bearing piece included in the same angle adjusting mechanism for an antenna.

With reference to FIGS. 6 and 4, the bearing piece 14 includes a central slotted portion 18 having a concave surface for supporting beneath the spherical hollow body 32, a resilient tab 19 protruding upwards from the slotted portion 18 and pressing against the groove 310 on the outside surface of the hollow body 32 in an assembled state, and two anchoring holes 17.

When assembling, first connect the connecting sleeve 21 of the antenna 20 to the first pivoting sleeve 33 of the linking member 30. Meanwhile, wire the signal cable (not shown) of the antenna 20 through the internal of the linking member 30. Next, tilt the linking member 30, insert it into the pivoting portion 13, and then turn it straight so that the second and third pivoting sleeves 34, 35 of the linking member 30 are inserted to the pivoting holes 16 of the pivoting recess 13. Thereafter, install the bearing piece 14 onto a proper location in the pivoting portion 13 and fasten the bearing piece 14 onto the upper casing 11 with a screw 41 through each anchoring hole 17. By thus, the linking member 30 is pivotably connected to the pivoting portion 13 and the resilient tab 19 of the bearing piece 14 press against the groove 310 of the hollow body 32. Finally, the upper casing 11 is fastened to the lower casing 12 to form a whole casing 10.

With reference to FIG. 3 and FIG. 4, by the above-described construction, the antenna 20 can pivot relative to the linking member 30 along the x direction shown in FIG. 3 (namely around the axis of the first pivoting sleeve 33), and the linking member 30 can also pivot relative to the case 10 along the y direction (namely around the common axis of the second and third pivoting sleeves 34, 35). Thus, the antenna 20 can perform angle adjustment in any direction so as to avoid the blind corner in signal transmitting and receiving.

Besides, since each of the three pivoting sleeves 33, 34, and 35 has its own resilience design, namely slotted or split free end 36 and resilient tab 37 which provide resilient connections. With the resilience design of the first pivoting sleeve 33, it produces a press fitting effect when the first pivoting sleeve 33 is connected to the connecting sleeve 21 of the antenna 20 which can retain the antenna 20 at any angular position along the x direction. Similarly, with the resilience design of the second and third pivoting sleeves 34 and 35, and further with the resilience of the resilient tab 19 of the bearing piece 14 pressing against the groove 310 of the hollow body 32, it generates a damping effect when the second and third pivoting sleeves 34 and 35 are connected to the pivoting portion 13 of the casing 10 which may retain the linking member 30 at any angular position along the y direction relative to the casing 10.

From the above description, it can be understood that, when the linking member 30 is connected between the casing 10 and the antenna 20, good damping effect for retaining the antenna 20 at a desired angular position can be achieved due to the resilience design of the linking member 30, even though no O ring is interposed between the connected portions. Consequently, the overall manufacturing cost can be reduced without the necessity of installing any extra parts such as O rings.

Furthermore, the hollow body 32 of the linking member 30 in this invention is designed in a spherical shape which has a bigger internal space than a cylindrical one. As a result, the internal wiring become easier. Thus, it becomes more convenient to install the signal cable. Moreover, the pair of half-housings 31A and 31B of the linking member 30 are formed with tenon and mortise joints which can accurately position the two relative to each other.

Although this invention has been shown and described with reference to a preferred embodiment thereof for easy understanding of the skills of the invention, it should not be considered as limited thereby. All changes, which come within the meaning and range of equivalency of the claims, are therefore intended to be embraced therein.

What is claimed is:

1. An angle adjusting mechanism for an antenna adapted to connect the antenna to its casing, comprising:

a pivoting portion provided in the casing;

a connecting sleeve provided in the antenna; and a linking member having a hollow body, a first pivoting sleeve, a second pivoting sleeve, and a third pivoting sleeve, with said first, second and third pivoting sleeves being integrally attached to said hollow body, and with said second and third pivoting sleeves being aligned with each other and substantially perpendicular to said first pivoting sleeve to form a generally T-shape; said first pivoting sleeve being connected, at the free end thereof, to said connecting sleeve of said antenna, and said second and third pivoting sleeves being pivotably connected, at respective free end thereof, to said pivoting portion of the casing so that the antenna may be pivotably connected to the casing through said linking member;

characterized in that each of said first, second, and third pivoting sleeves of said linking member is provided with a split or slotted free end and resilient tabs for pressing against the portions connected with said first, second, and third pivoting sleeves in an assembled state so that said first, second, and third pivoting sleeves may be connected to said connecting sleeve of the antenna and said pivoting portion of the casing in a resilient manner.

2. An angle adjusting mechanism for an antenna according to claim 1, wherein said linking member is formed by a pair of half-housings coupled to each other.

3. An angle adjusting mechanism for an antenna according to claim 1, wherein said pair of half housings are provided with tenon and mortise joints.

4. An angle adjusting mechanism for an antenna according to claim 1, wherein said hollow body is formed in a sphere shape.

5. An angle adjusting mechanism for an antenna according to claim 1, further comprising a bearing piece mounted within said pivoting portion of the casing for bearing beneath said hollow body of said linking member.

6. An angle adjusting mechanism for an antenna as described in the claim 5, wherein said bearing piece includes a slotted portion for supporting beneath said hollow body of said linking member, and a resilient tab for upwards pressing against said hollow body in a resilient manner.

7. An angle adjusting mechanism for an antenna according to the claim 6, wherein said hollow body of the linking member is provided, on the outside surface thereof and opposing said resilient tab of said bearing piece, with a groove so that said resilient tab of said bearing piece may press against said groove.

* * * * *